US007168825B2

(12) United States Patent
McArthur

(10) Patent No.: US 7,168,825 B2
(45) Date of Patent: Jan. 30, 2007

(54) RECESSED LIGHT FIXTURE

(76) Inventor: Robert M. McArthur, P.O. Box 449, Pemberton, British Columbia (CA) V0N 2L0

( * ) Notice: Subject to any disclaimer, the term of this patent is extended or adjusted under 35 U.S.C. 154(b) by 110 days.

(21) Appl. No.: 11/100,006

(22) Filed: Apr. 7, 2005

(65) Prior Publication Data

US 2006/0227535 A1 Oct. 12, 2006

(51) Int. Cl.
*F21V 29/00* (2006.01)

(52) U.S. Cl. ..... 362/267; 362/153.1; 362/276; 362/364

(58) Field of Classification Search ..... 362/153.1, 362/267, 276, 294, 364, 365, 374, 375
See application file for complete search history.

(56) References Cited

U.S. PATENT DOCUMENTS 5,156,454 A 10/1992 White
5,481,443 A 1/1996 Wagner et al.
5,887,966 A 3/1999 Eissner et al.
6,550,931 B1 4/2003 Olson, Jr.
6,840,649 B2 * 1/2005 Reinert, Sr. ..... 362/153.1
2004/0156191 A1 8/2004 Biasoli et al.
2004/0184263 A1 9/2004 Patti

* cited by examiner

*Primary Examiner*—Stephen F Husar
(74) *Attorney, Agent, or Firm*—Frederick Kaufhan Inc.

(57) ABSTRACT

A recessed insert fixture uses a housing shaped as a hollow, single piece cylinder that comprises a top and a bottom and starts from the top with an internal, shallow cylindrical cavity and continues downwardly with an internal, deep cylindrical cavity. The interior diameter of the former is lesser than the interior diameter of the latter. A first annular channel starting from the top is coaxial with the internal, shallow cylindrical cavity. A second annular channel extends radially, proximately to the top, into a wall of the internal, shallow cylindrical cavity. Two O-rings are used. One is inserted into first annular channel. The other one is inserted into the second annular channel. When the fixture is assembled, the first O-ring is compressed directly by a lid, the other one indirectly by the same lid that acts on a flange and surface of a lamp reflector.

2 Claims, 5 Drawing Sheets

RECESSED LIGHT FIXTURE

BACKGROUND OF THE INVENTION

1. Field of the Invention

The present invention relates generally to low voltage lighting systems, and more particularly to a recessed light fixture.

2. Description of the Related Art

Recessed light fixtures are in widespread use in residential and commercial use premises. They appeal to designers both for the fact that they take up virtually no space in a room, being generally recessed into the floor, ceiling and vertical walls.

In the landscaping arts, it is customary to delimit flower beds, lawns and pathways with masonry edging. The use of this type of edging requires a lot of time and a variety of building elements.

It has been found that there was a need for a low-voltage lighting system which may be used flush to a mounting surface.

Several patents have addressed the issue of developing and improving recessed light fixtures. Thus, U.S. Pat. No. 6,491,407, granted on Dec. 10, 2002 to Beadle for an "IN-GROUND LIGHTING FIXTURE WITH GIMBALED LAMP ASSEMBLY" describes a fixture having a housing incorporating a lamp assembly comprising a shroud portion, a window and a base portion which encloses a lamp and a reflector. A first end of the base portion is provided with external screw threads with an O-ring seat formed below the lowest thread. The outer diameter of the O-ring is larger than the diameter of the external screw threads, thus generating significant resistance to the relative rotation of the base and shroud portions causing the O-ring to be compressed. Beadle's device presents three main disadvantages. First, it is difficult to assess whether the relative rotation is terminated and an appropriate sealing is achieved, since it depends on the strength of the person performing the assembling. Second, generally, no tool can be used for the tightening operation. Third, machining the screw threads requires precision and it is costly. EP Patent No. 1,467,142, published Oct. 13, 2004, the name of the inventor Mas Phillipe and having the title "LUMINAIRE RECESSED IN THE GROUND COMPRISING A TEMPERATURE REDUCTION SYSTEM" discloses a light having a reservation pot that includes vertical blades passing through interior of a circular space filled with air. A lighting body has exterior vertical blades that pass through the interior of the circular space and are inserted between the vertical blades. The vertical and the exterior vertical blades are distributed all around the periphery of the light to form a temperature reduction system. The main shortcoming of the foregoing system resides in its complexity.

SUMMARY OF THE INVENTION

Based on the above discussion, there is a need for an improved recessed light fixture.

It is a first objective of the present invention to develop a well engineered recessed fixture, with enhanced reliability and service life.

It is a second objective of the present invention to develop a recessed light fixture capable of withstanding pedestrian weight.

It is a third objective of the present invention to so design a recessed light fixture, as to more effectively dissipate heat generate by the light source.

It is a fourth objective of the present invention to construct a recessed light fixture, adaptable to any climate or weather, so that snow and ice could melt of easily.

It is a fifth objective of the present invention to easily install and service the fixture.

Broadly describing, the recessed light fixture, according the present invention comprises:

a housing;

a sealing subassembly mounted to the housing for waterproofing it;

an electrical light subassembly positioned within the housing;

a lid subassembly superimposed on the housing for closing it when the electrical light subassembly and the sealing subassembly are already mounted to the housing; and a fastening subassembly for affixing the lid subassembly to the housing and for securing the latter to a firm member of a in-floor or alike structure.

The housing has a shape of a hollow, single piece cylinder, is provided with a top and a bottom and starts from the top with an internal, relatively shallow cylindrical cavity and continues downwardly towards the bottom with an internal, relatively deep cylindrical cavity. The interior diameter of the former is lesser than the interior diameter of the latter.

The housing has, as well, several closed, threaded holes, equidistantly spaced on a circumference coaxial with the external circumference of the housing and the circumference of the internal, relatively shallow cylindrical cavity. The several closed, threaded holes are disposed between the former and the latter and extend from the top inwardly into a wall situated between a surface defined by the external circumference of the housing and a surface of the internal, relatively deep cylindrical cavity.

The housing also incorporates:

a first annular shallow channel starting from the top and disposed between the circumference corresponding to the several threaded holes and the circumference corresponding to the internal, relatively shallow cylindrical cavity; the first annular shallow channel being coaxial with the foregoing circumferences; and a second annular shallow channel extending radially, proximately to the top, into a wall of the internal, relatively shallow cylindrical cavity.

The cylindrical external surface of the housing is interrupted, adjacent to the bottom, by a flat, relatively small zone. An identical, threaded aperture is formed, centrally, in each mentioned items, namely the bottom and the flat, relatively small zone. One of the identical, threaded apertures is usually closed by a sealing, threaded plug.

A pair of closed, threaded openings being situated approximately midway between the top and the bottom and located diametrically, extends radially from the cylindrical external surface of the housing into the wall of the latter.

the sealing subassembly includes a first and second O-rings.

The first O-ring is partially inserted into the first annular shallow channel and partially protruding outside the latter.

The second O-ring is partially inserted into the second annular shallow channel and partially protruding outside the latter.

The electrical light subassembly is located within the housing and includes a lamp socket to which is plugged a lamp, usually of low voltage, located in a focus of a reflector having a base end and an upper end. Generally, the lamp and the reflector form an unitary part. The latter extends outwardly and horizontally into a peripheral, substantially flat flange. The reflector is internally received in the housing and seated with the peripheral, substantially flat flange and partially with its upper end of the reflector on a shoulder. The shoulder is located within the annular shallow channel and formed by a protruding part of the second O-ring. Thus, the reflector engages and is retained against the latter. In a position corresponding to the recessed light fixture not completely assembled, the peripheral flat flange protrudes somewhat above the top of the housing.

The electrical light subassembly includes as well means for reacting to excess of temperature. The light emitting source of the recessed light is controlled by the means for reacting to excess of temperature that detects when a temperature of the recessed light fixture exceeds a temperature permissible by regulatory codes and turns off the light. A water-tight fitting is tightened into one of the two threaded apertures, the other one being closed by the sealing, threaded plug. The electrical light subassembly is adapted to use an electrical wiring entering/exiting throughout the water-tight fitting and connectors for interconnecting the lamp socket and the means for reacting to excess of temperature. Potting material is used for attaching to the interior of the housing, after their insulation, the means for reacting to excess of temperature.

The lid subassembly includes first lid means for contacting with the top of the housing and second lid means for superposing on the first lid means. Both the first and second lid means are provided, for allowing light to pass therethrough, with a lens, and, for attaching to the housing, with several bores coinciding with the several closed, threaded holes that extent into the housing.

Each of the several bores, drilled into the first lid means for contacting with the top of the housing, is provided with a lower threaded part and an upper cylindrical part. The lower threaded part has a diameter larger than the diameter of the closed, threaded holes, while the upper cylindrical part has a diameter larger than the lower threaded part. A plurality of slots, disposed in the second lid means for superposing on the first lid means, communicate with an internal space wherein heated air is generated between the first lid means for contacting with the top of the housing and the second lid means for superposing on the first lid means.

The recessed light fixture further comprises fastening means for affixing the lid subassembly to the housing and for securing the latter to a firm member of an in-floor or alike structure.

In one aspect of the present invention, a housing for use in a recessed light fixture comprises a housing;

a sealing subassembly mounted to the housing for waterproofing it;

an electrical light subassembly positioned within the housing;

a lid subassembly superimposed on the housing for closing it when the electrical light subassembly and the sealing subassembly are already mounted to the housing; and a fastening subassembly for affixing the lid subassembly to the housing and for securing the latter to a firm member of a in-floor or alike structure.

The housing for use in a recessed light fixture has a shape of a hollow, single piece cylinder and is provided with a top and a bottom and starts from the top with an internal, relatively shallow cylindrical cavity and continues downwardly towards the bottom with an internal, relatively deep cylindrical cavity. The interior diameter of the former is lesser than the interior diameter of the latter.

The housing has also several closed, threaded holes, equidistantly spaced on a circumference coaxial with and between the external circumference of the housing and the circumference of the internal, relatively shallow cylindrical cavity, and disposed between the former and the latter. The several closed, threaded holes extend from the top inwardly into a wall situated between a surface defined by the external circumference of the housing and a surface of the internal, relatively deep cylindrical cavity.

The housing also incorporates a first annular shallow channel starting from the top and disposed between the circumference corresponding to the several threaded holes and the circumference corresponding to the internal, relatively shallow cylindrical cavity. The first annular shallow channel is coaxial with the foregoing circumferences.

A second annular shallow channel extends radially, proximately to the top, into a wall of the internal, relatively shallow cylindrical cavity. The cylindrical external surface of the housing is interrupted, adjacent to the bottom, by a flat, relatively small zone. An identical, threaded aperture is formed, centrally, in each mentioned items, namely the bottom and the flat, relatively small zone. One of the identical, threaded apertures is usually closed by a sealing, threaded plug. The housing finally comprises a pair of closed, threaded openings, situated approximately midway between the top and the bottom and located diametrically, that extends radially from the cylindrical external surface of the housing into the wall of the latter.

BRIEF DESCRIPTION OF THE DRAWINGS

Although the characteristic features of the invention will be particularly pointed out in the claims, the invention itself and the manner in which it may be made and used may be better understood by referring to the following description and accompanying drawings. Like reference numerals refer to like parts throughout the several views of the drawings in which:

Figure 1:
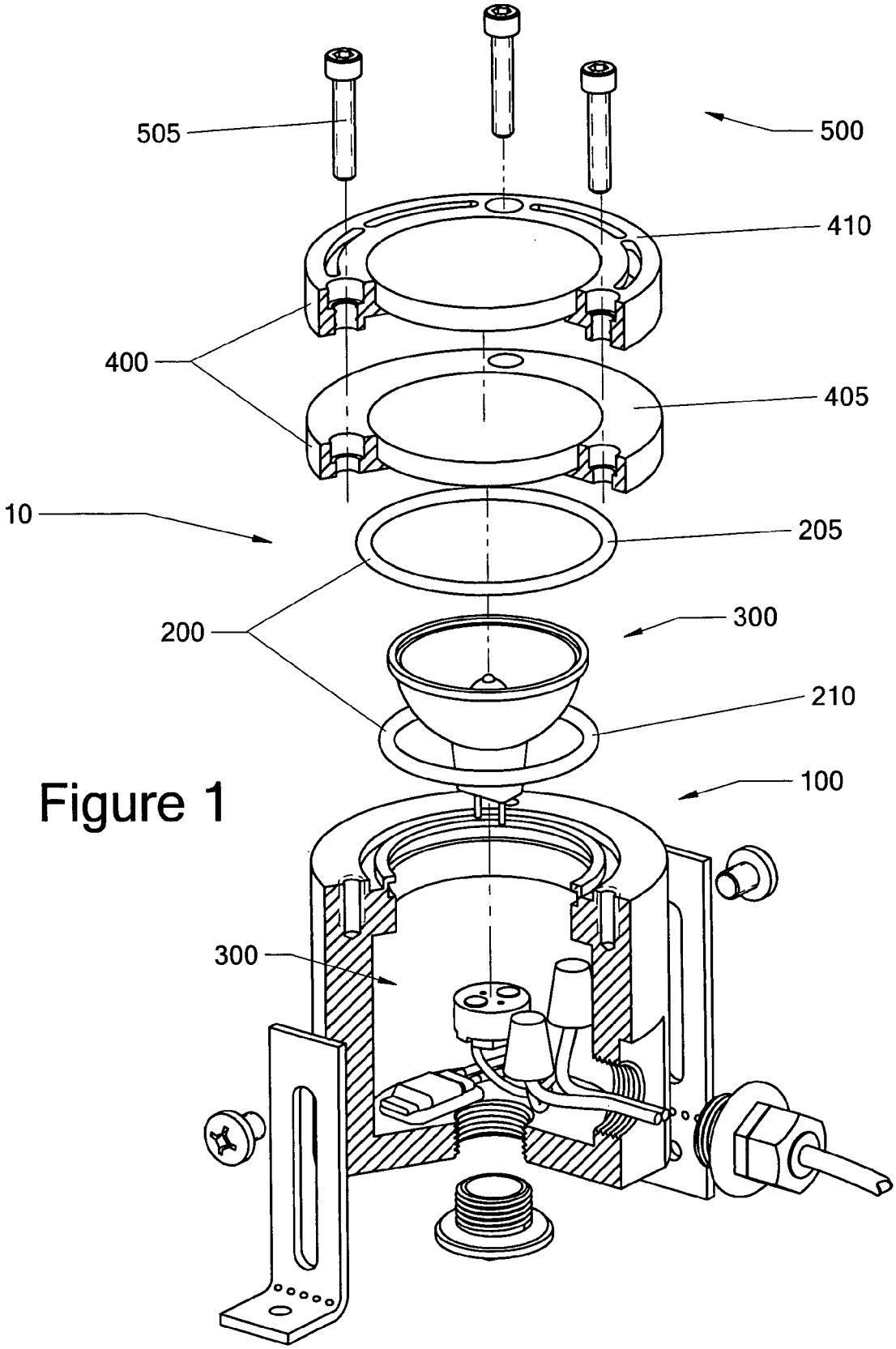
FIG. 1 is an exploded perspective view of the recessed insert fixture of the present invention, with a portion of the housing vertically sectioned at 120°.

The accompanying drawings illustrate a preferred embodiment of the present invention: a recessed light fixture 10.

It is to be agreed, that terms, such as "top", "bottom", "vertical" and "horizontal" are conventionally considered in the present description with reference to the use of recessed light fixture 10 in-floor or in-ground. The foregoing use is not limiting. Recessed light fixture 10 could be adapted as well for vertical wall marking or for allowing light rays to pass to the surrounding environment from the ceiling.

The preferred embodiment comprises five primary components:

a housing 100;

a sealing subassembly 200 mounted to housing 100 for waterproofing the latter;

an electrical light subassembly 300 positioned within housing 100;

a lid subassembly 400 superimposed on housing 100 for closing it when electrical light subassembly 200 and sealing subassembly 300 are already mounted to housing 100; and a fastening subassembly 500 for affixing lid subassembly 400 to housing 100 and for securing the latter to a firm member of a in-floor or alike structure.

Figure 2:
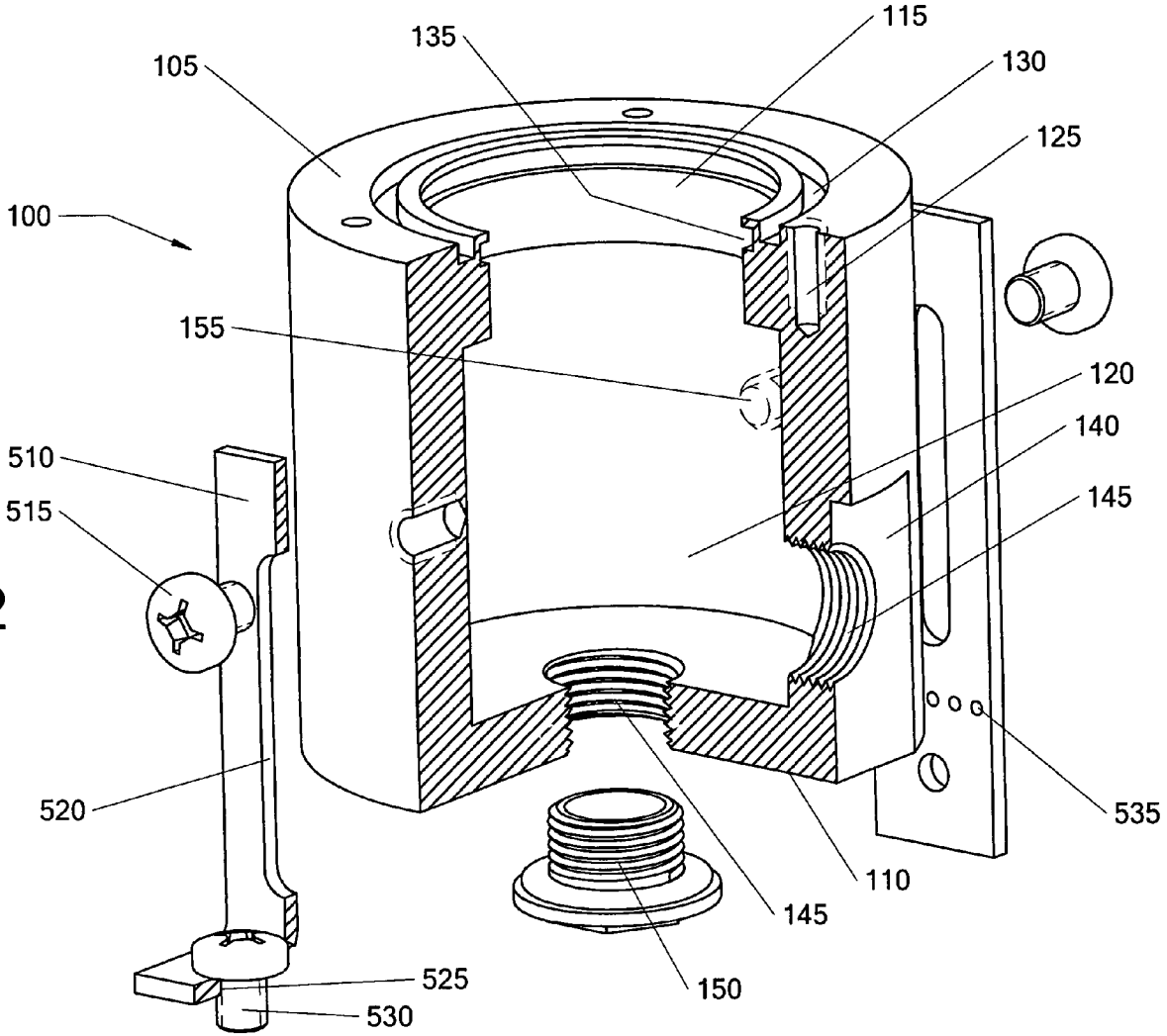
FIG. 2 is a perspective view of the housing of the present invention with a portion shown in sectional view at 120°.
Figure 3:
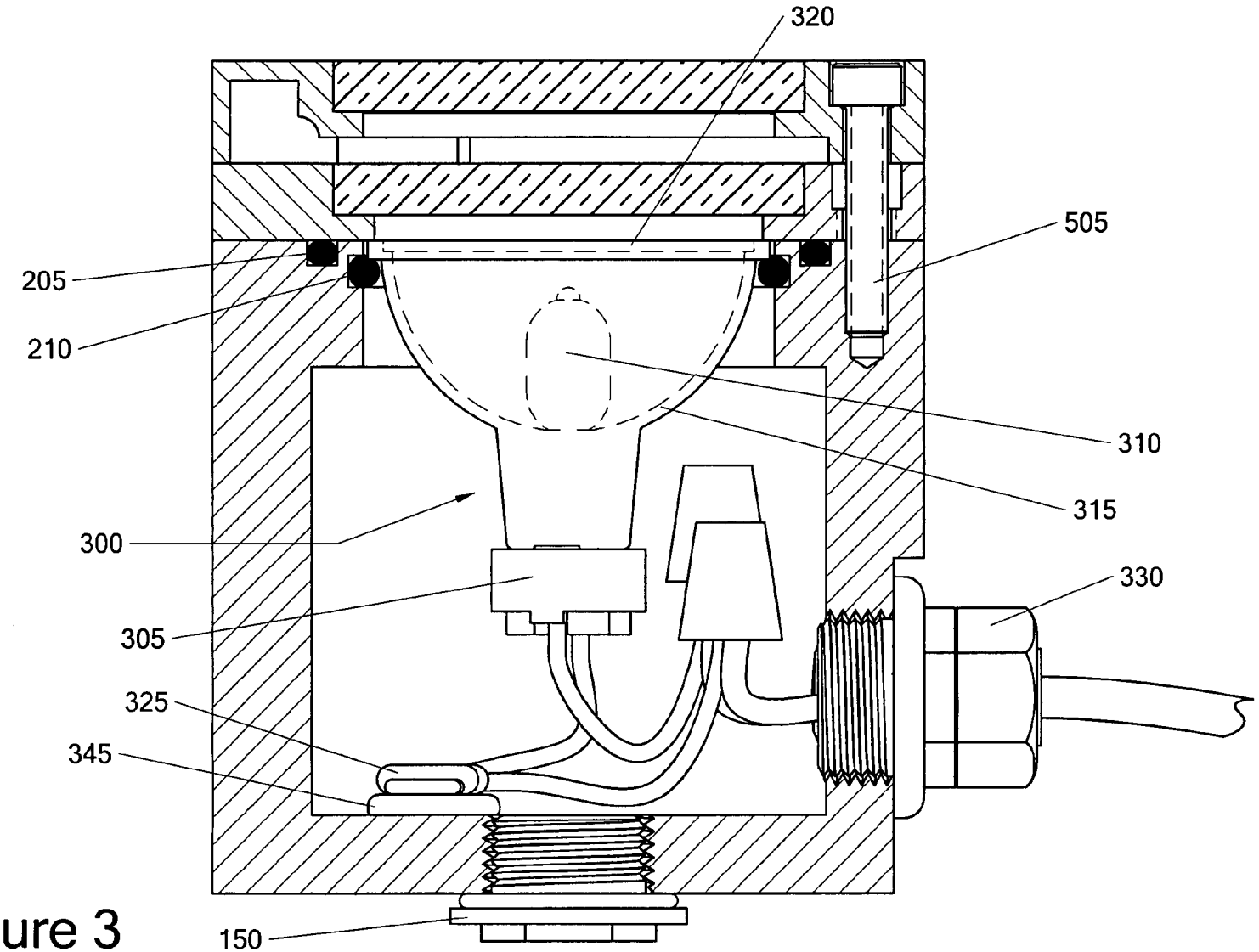
FIG. 3 is a vertical cross-section of the recessed insert fixture, depicted without the pair of brackets and their screws.

Turning to FIGS. 1 to 3, housing 100 is depicted as a hollow, single piece cylinder that is provided with a top 105 and a bottom 110 and starts from top 105 with an internal, relatively shallow cylindrical cavity 115 and continues downwardly towards bottom 110 with an internal, relatively deep cylindrical cavity 120. Housing 100, internal, relatively shallow cylindrical cavity 115 and internal, relatively deep cylindrical cavity 120 are coaxial and the interior diameter of the former is lesser than the interior diameter of the latter.

Three closed, threaded holes 125 are equidistantly spaced on a circumference coaxial with and between the external circumference of housing 100 and the circumference of internal, relatively shallow cylindrical cavity 115, and disposed between the former and the latter. Three closed, threaded holes 125 extend from top 105 inwardly into a wall situated between a surface defined by the external circumference of housing 100 and a surface of internal, relatively deep cylindrical cavity 120.

A first annular shallow channel 130 that starts from top 105 is disposed between the circumference corresponding to the three threaded holes 125 and the circumference corresponding to internal, relatively shallow cylindrical cavity 115. First annular shallow channel 130 is coaxial with the foregoing circumferences.

A second annular shallow channel 135 extends radially, proximately to top 105, into the wall of internal, relatively shallow cylindrical cavity 115.

The cylindrical external surface of housing 100 is interrupted, adjacent to bottom 110, by a flat, relatively small zone 140. An identical, threaded aperture 145 is formed, centrally, in each mentioned items, namely bottom 110 and flat, relatively small zone 140. Usually, one of identical, threaded apertures 145 is closed by a sealing, threaded plug 150.

A pair of closed, threaded openings 155, situated approximately midway between top 105 and bottom 110 and diametrically located, extends from the cylindrical external surface of housing 100 into the wall of the latter.

As can be seen in FIG. 1, sealing subassembly 200 includes first and second O-rings 205 and, respectively, 210. First O-ring 205 is partially inserted into first annular shallow channel 130 and partially protrudes outside the latter. Second O-ring 210 is partially inserted into second annular shallow channel 135 and partially protrudes outside the latter.

Turning to FIG. 3, electrical light subassembly 300 that is positioned within housing 100 comprises:

a lamp socket 305 to which is plugged, a lamp 310 located in a focus of a parabolic reflector 315 that has a base end and a upper end, the latter extending outwardly and horizontally into a peripheral, substantially flat flange 320; lamp 310, combined with parabolic reflector 315 in one entity, used in this embodiment, is of low voltage type (12V) lamp, commercially available under the name MR 16; optionally, other normal or low voltage lamps or LED (light emitting diode) lamps can be used; parabolic reflector 315 is received internally in housing 100 and seated with its peripheral, substantially flat flange 320 and partially with its upper end of parabolic reflector 315 on a shoulder located within second annular shallow channel 130; the shoulder is formed by the protruding part of second O-ring 210 and, thus, parabolic reflector 315 engages and is retained against the latter; in this position, when recessed light fixture 10 is not completely assembled, peripheral flat flange 320 protrudes somewhat above top 105 of housing 100; it results from the foregoing description that second O-ring 210 serves a dual function: facilitates centering and stable placement of parabolic reflector 315 relative to housing 100 and provides a seal around the former (parabolic reflector 315);

a bi-metal thermal cutout 325; the light emitting source of recessed light fixture 10 is controlled by bi-metal thermal cutout 325 that detects, when a temperature of recessed light fixture 10 exceeds a temperature permissible by regulatory codes, and turns off the light; this occurs in the event when the top of recessed light fixture 10 is obstructed and an effective dissipation of the heat generated by lamp 310 is disrupted);

a water-tight fitting 330 tightened into one of the two threaded apertures 145, the other one being closed by sealing, threaded plug 150; a commercially known type of a water-tight fitting 330 is manufactured and distributed by Thomas & Betts; since the selection of appropriate fittings that provide the required watertight characteristics is well known to those skilled in the art, further detailed description of a this fitting is not deemed necessary;

electrical wiring 335 adapted to enter/exit throughout water-tight fitting 330 and conveniently use connectors 340 for interconnecting lamp socket 305 and bi-metal thermal cutout 325; and lamp epoxy potting 345 or other appropriate potting material or sealant injected into the interior of housing 100 for attaching bi-metal thermal cutout 325 to the latter (bi-metal thermal cutout 325 must be, prior to attaching, insulated against a direct contact with the interior of housing 100).

Figure 4:
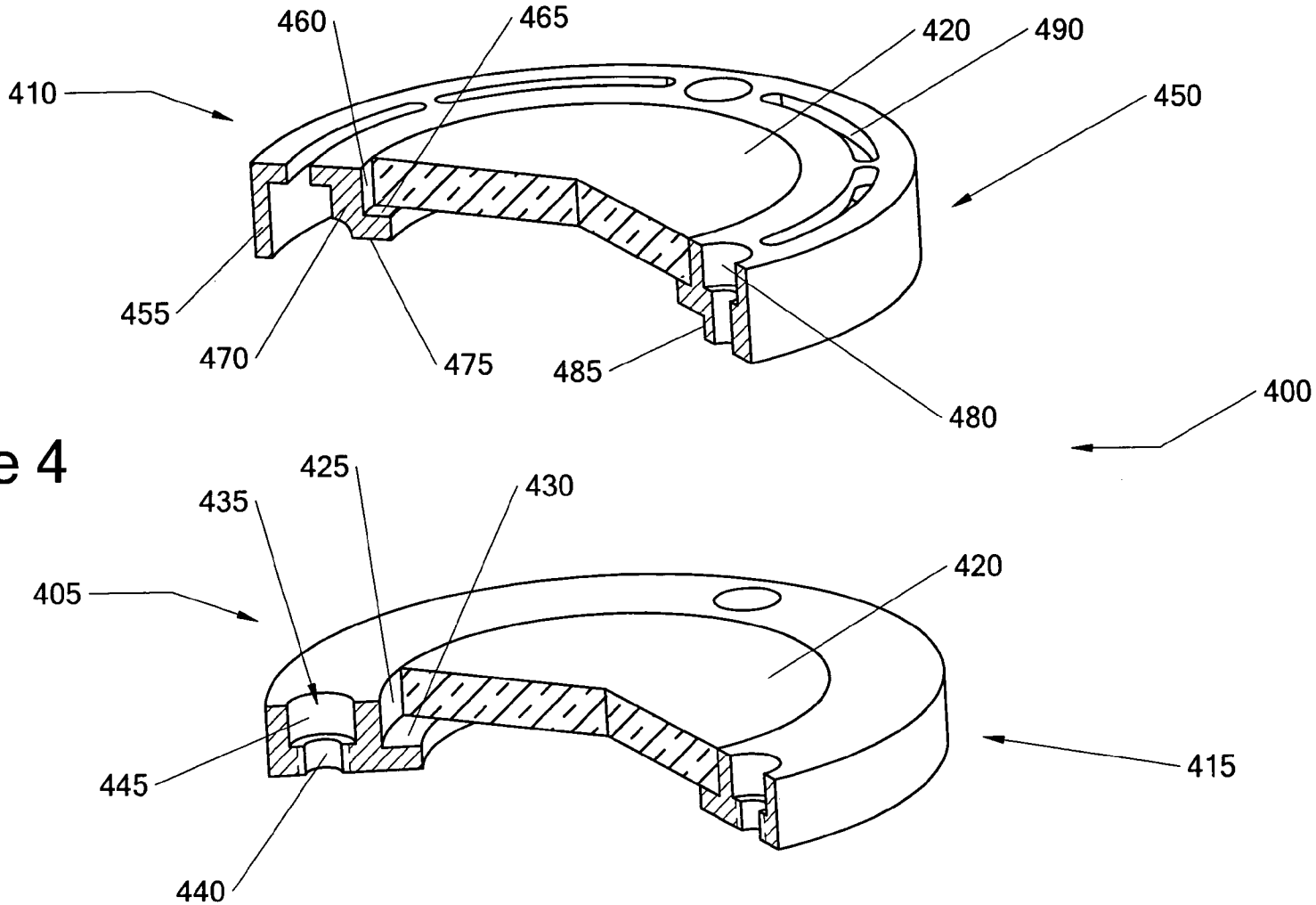
FIG. 4 is a perspective view of the lid subassembly wherein first and second lids are partially shown in cross-section.
Figure 6:
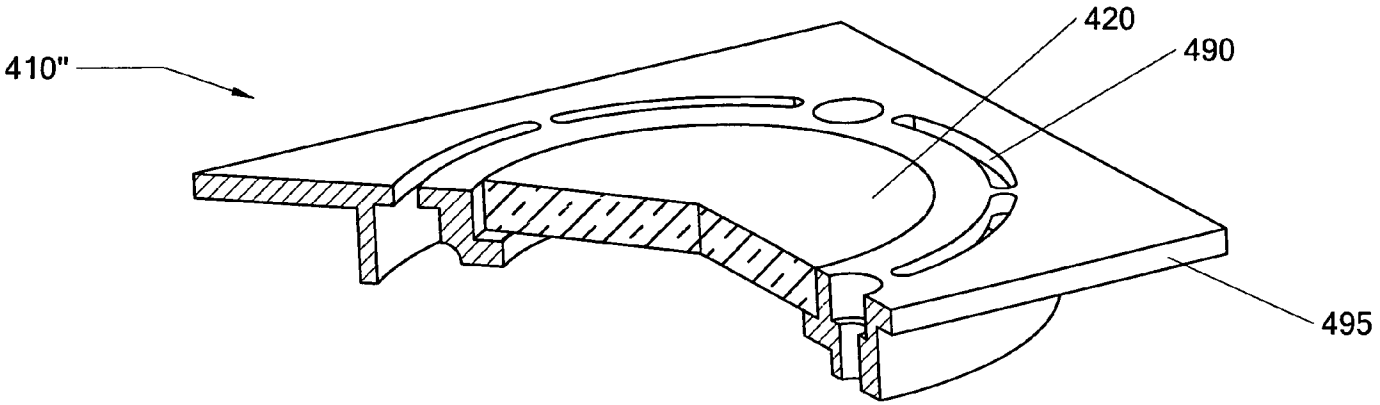
FIG. 6 is a perspective view, partially in cross-section, of another variant of the second lid of FIG. 4, wherein a square flange is used.
Figure 5:
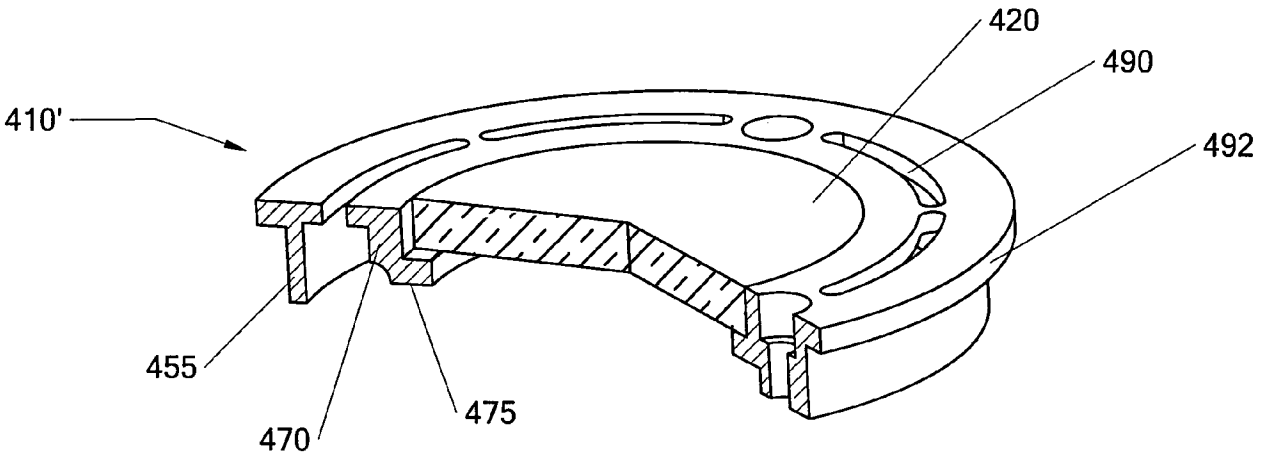
FIG. 5 is a perspective view, partially in cross-section, of a variant of the second lid of FIG. 4, wherein a flange of flat, circular shape is used.

Lid subassembly 400, as seen in FIG. 4 comprises: a first lid 405 for direct contact with top 105 of housing 100 and a second lid 410 superposed on first lid 405. Both, first and second lids 405 and 410 are concentrically disposed with housing 100. First lid 405 includes a disc element 415 that centrally supports, for allowing light to pass therethrough, a transparent or translucent lens 420. Disc element 415 incorporates coaxially a central cylindrical well 425 that is inwardly extending and abuts an annular peripheral rim 430. The latter has its external, lower surface coplanar with a bottom surface of disc element 415. Lens 420 is disposed in central circular well 425 and rests on annular peripheral rim 430. A depth of central cylindrical well 425 is generally commensurate with a thickness of lens 420. Thus, an upper surface of lens 420 is substantially coplanar with an upper surface of disc element 415. An adhesive is used to provide a hermetic seal between lens 420 and annular peripheral rim 430.

Three equidistant bores 435 perpendicularly traverse disc element 415 and are so drilled to coincide with the three closed, threaded holes 125 that extend from top 105 of housing 100 into the latter. Each one of the three equidistant bores 435 has a lower threaded part 440 and an upper cylindrical part 445. The lower threaded part 440 has a diameter larger than the diameter of the three closed, threaded holes 125 and upper cylindrical part 445 has a diameter larger than the lower threaded part 440. In some situations when it is difficult to detach/extract first lid 405 from housing 100, a threaded bolt (not shown) is first introduced and centered through upper cylindrical part 445 and, then, tightened into lower threaded part 440.

Second lid 410 comprises a disc 450 surrounded by a downwardly projecting peripheral wall 455. Disc 450 incorporates coaxially a central cylindrical recess 460 that extends inwardly and abuts an annular flat rim 465. Central cylindrical recess 460 is encircled by a peripheral, cylindrical enclosure 470 that is spaced from downwardly projecting peripheral wall 455. A lens 420 is lodged in central cylindrical recess 460 and attached with a adhesive to annular flat rim 465. A depth of central cylindrical recess 460 is commensurate with a thickness of lens 420. An external lower surface 475 of annular flat rim 465 is retracted from a lower surface of downwardly projecting peripheral wall 455.

Three countersunk bores 480 start from a top of disc 450 and are each drilled in a boss 485. Three countersunk bores 480 coincide with three equidistant bores 435 and with the three closed, threaded holes 125 that extend from top 105 of housing 100. Each boss 485 extends downwardly, ending at the same lower level as downwardly projecting peripheral wall 455. Each boss 485 is so molded that it laterally joins, at one side, an internal surface of downwardly projecting peripheral wall 455 and, at another side, an external surface of peripheral cylindrical enclosure 470. A plurality of elongated slots 490 are equally spaced and circularly disposed between three countersunk bores 480. Heated air spaced between internal surface of downwardly projecting peripheral wall 455, external surface of peripheral cylindrical enclosure 470, bottom of annular flat rim 465 and the top of first lid 405 can exit through plurality of elongated slots 490. The latter have their length and width generally limited to prevent some vandalism acts, such as insertions of flammable elements therethrough.

The foregoing embodiment describes a recessed light fixture 10 having the top of disc 450 flush with a floor, a pavement or a wall wherein recessed light fixture is embedded.

In a first variant of the above embodiment, use is made of a second lid 410', similar to second lid 410. Having an identical height, second lid 410' is provided, at its top, with a flange 492 of flat, circular shape.

In a second variant, use is made of a second lid 410", similar to second lid 410'. The only difference resides in the fact that second lid 410" is provided with a square flange 495.

In both variants, the flanged part is not flash-fitted in the floor, but protrudes therefrom. Besides their main purpose of projecting light, the above flanged variants can be used for holding down the ends of floor covering, such as rugs, carpeting, etc., and for enhancing aesthetic versatility and appeal of recessed light fixtures.

The second lid includes the described configurations, but it is not limited to them. Triangular, pentagonal, etc. can also be used.

Fastening subassembly 500 includes:

three hexagon socket head screws 505, made of a corrosion-resisting metal;

a pair of brackets 510, which, when required, could be bent at 90 degrees, are used for securing recessed light fixture 10 to an adjacent structure (not shown); and a pair of screws 515 for attaching the pair of brackets 510 to housing 100; the pair of screws 515 is tightened into the pair of closed, threaded openings 155 of housing 100.

The three hexagon socket head screws 505 serve to attach lid subassembly 400 to housing 100. To this end, they traverse:

second lid 410 (three countersunk bores 475 of disc 450);

first lid 405 (three equidistant bores 435 of disc element 415): and are tightened into three closed, threaded holes 125 of housing 100. In this situation, first and second O-rings 205 and 210 are, substantially, compressed into first and second annular shallow channels 130 and 135; top 105 of housing 100, an external upper surface of peripheral flat flange 320 and bottom surface of disc element 415 are now coplanar.

Each one of the pair of brackets 510 is provided with a height adjustment slot 520;

an aperture 525 to be used with a fastener 530 for securing bracket 510 to an adjacent structure;

and a transversal punched line 535. The latter is used for bending securing bracket at 90°, when the attachment to a structure requires it.

In the above embodiment, anodized hard coat aluminum has been used for housing 100, for disc element 415 and for disc 450. Optionally, other materials such as rigid plastic materials and nonferrous metals could also be used for the foregoing items. High-temperature resistant compound has been used for first and second O-rings 205 and 210, while tempered glass- for lenses 420.

As required, a detailed embodiment of the present invention is disclosed herein; however, it is to be understood that the disclosed embodiment is merely exemplary of the invention which may be embodied in various forms. Therefore, specific structural and functional details disclosed herein are not to be interpreted as limiting, but merely as a basis for the claims and as representative basis for teaching one skilled in the art to variously employ the present invention in virtually any appropriately detailed structure.

I claim:

1. A housing for use in a recessed light fixture, the latter comprising a housing;

a sealing subassembly mounted to said housing for waterproofing it;

an electrical light subassembly positioned within said housing;

a lid subassembly superimposed on said housing for closing it when said electrical light subassembly and said sealing subassembly are already mounted to said housing; and a fastening subassembly for affixing said lid subassembly to said housing and for securing the latter to a firm member of a in-floor or alike structure;

said housing for use in a recessed light fixture having a shape of a hollow, single piece cylinder is provided with a top and a bottom and starts from said top with an internal, relatively shallow cylindrical cavity and continues downwardly towards said bottom with an internal, relatively deep cylindrical cavity, the interior diameter of the former being lesser than the interior diameter of the latter;

said housing having also several closed, threaded holes, equidistantly spaced on a circumference coaxial with and between the external circumference of said housing and the circumference of said internal, relatively shallow cylindrical cavity, and disposed between the former and the latter, said several closed, threaded holes extending from said top inwardly into a wall situated between a surface defined by the external circumference of said housing and a surface of said internal, relatively deep cylindrical cavity;

said housing also incorporating a first annular shallow channel starting from said top and disposed between the circumference corresponding to said several threaded holes and the circumference corresponding to said internal, relatively shallow cylindrical cavity, said first annular shallow channel being coaxial with the foregoing circumferences; and a second annular shallow channel extending radially, proximately to said top, into a wall of said internal, relatively shallow cylindrical cavity;

said cylindrical external surface of said housing being interrupted, adjacent to said bottom, by a flat, relatively small zone, while an identical, threaded aperture being formed, centrally, in each mentioned items, namely said bottom and said flat, relatively small zone, one of said identical, threaded apertures being usually closed by a sealing, threaded plug; and a pair of closed, threaded openings, situated approximately midway between said top and said bottom and located diametrically, extends radially from said cylindrical external surface of said housing into the wall of the latter, said sealing subassembly including a first and second O-rings, said first O-ring being partially inserted into said first annular shallow channel and partially protruding outside the latter, said second O-ring being partially inserted into said second annular shallow channel and partially protruding outside the latter.

2. A recessed light fixture comprising, in combination a housing;

a sealing subassembly mounted to said housing for waterproofing the latter;

an electrical light subassembly positioned within said housing;

a lid subassembly superimposed on said housing for closing it when said electrical light subassembly and said sealing subassembly are already mounted to said housing; and a fastening subassembly for affixing said lid subassembly to said housing and for securing the latter to a firm member of a in-floor or alike structure;

said housing, having a shape of a hollow, single piece cylinder, being provided with a top and a bottom and starts from said top with an internal, relatively shallow cylindrical cavity and continues downwardly towards said bottom with an internal, relatively deep cylindrical cavity, the interior diameter of the former being lesser than the interior diameter of the latter;

said housing having also several closed, threaded holes, equidistantly spaced on a circumference coaxial with and between the external circumference of said housing and the circumference of said internal, relatively shallow cylindrical cavity, and disposed between the former and the latter, said several closed, threaded holes extending from said top inwardly into a wall situated between a surface defined by the external circumference of said housing and a surface of said internal, relatively deep cylindrical cavity;

said housing also incorporating a first annular shallow channel starting from said top and disposed between the circumference corresponding to said several threaded holes and the circumference corresponding to said internal, relatively shallow cylindrical cavity, said first annular shallow channel being coaxial with the foregoing circumferences; and a second annular shallow channel extending radially, proximately to said top, into a wall of said internal, relatively shallow cylindrical cavity;

said cylindrical external surface of said housing being interrupted, adjacent to said bottom, by a flat, relatively small zone, while an identical, threaded aperture being formed, centrally, in each mentioned items, namely said bottom and said flat, relatively small zone, one of said identical, threaded apertures being usually closed by a sealing, threaded plug; and a pair of closed, threaded openings situated approximately midway between said top and said bottom and located diametrically, extends radially from said cylindrical external surface of said housing into the wall of the latter;

said sealing subassembly including a first and second O-rings, said first O-ring being partially inserted into said first annular shallow channel and partially protruding outside the latter, said second O-ring being partially inserted into said second annular shallow channel and partially protruding outside the latter, said electrical light subassembly, located within said housing, including a lamp socket to which is plugged, a lamp, usually of low voltage, located in a focus of a reflector having a base end and a upper end, the latter extending outwardly and horizontally into a peripheral, substantially flat flange; said reflector being internally received in said housing and seated with said peripheral, substantially flat flange and partially with its upper end of said reflector on a shoulder located within said first annular shallow channel and formed by a protruding part of said second O-ring and, thus, said reflector engages and is retained against the latter; in a position corresponding to said recessed light fixture not completely assembled, said peripheral flat flange protruding somewhat above said top of said housing;

means for reacting to excess of temperature; the light emitting source of said recessed light being controlled by said means for reacting to excess of temperature that detects, when a temperature of said recessed light fixture exceeds a temperature permissible by regulatory codes, and turns off the light;

a water-tight fitting tightened into one of said two threaded apertures, the other one being closed by said sealing, threaded plug;

electrical wiring adapted to enter/exit throughout said water-tight fitting and use connectors for interconnecting said lamp socket and said means for reacting to excess of temperature; and potting material for attaching, after their insulation, said means for reacting to excess of temperature to the interior of said housing;

said lid subassembly incorporating first lid means for contacting with said top of said housing; and second lid means for superposing on said first lid means, both said first and second lid means being provided, for allowing light to pass therethrough, with a lens, and, for attaching to said housing, with several bores coinciding with said several closed, threaded holes that extent into said housing; each of said several bores, drilled into said first lid means for contacting with said top of said housing, being provided with a lower threaded part and an upper cylindrical part, said lower threaded part having a diameter larger than the diameter of said closed, threaded holes, while said upper cylindrical part has a diameter larger than said lower threaded part; a plurality of slots disposed in said second lid means for superposing on said first lid means, communicate with an internal space wherein heated air is generated between said first lid means for contacting with said top of said housing and said second lid means for superposing on said first lid means; and fastening means for affixing said lid subassembly to said housing and for securing the latter to a firm member of an in-floor or alike structure.

* * * * *